US005251380A

United States Patent [19]

Craig

[11] Patent Number: 5,251,380

[45] Date of Patent: Oct. 12, 1993

[54] HANDLE GRIP FOR A UTILITY KNIFE

[76] Inventor: Steven Craig, 6157 Briercrest, Lakewood, Calif. 90713

[21] Appl. No.: 930,717

[22] Filed: Aug. 14, 1992

[51] Int. Cl.[5] ..... B25G 1/00

[52] U.S. Cl. ..... 30/329; 30/340; 16/110 R; 16/DIG. 12

[58] Field of Search ..... 30/329, 162, 340; 16/110 R, 114 R, DIG. 12

[56] References Cited

U.S. PATENT DOCUMENTS 2,124,615 7/1938 Foltz ..... 30/340
2,951,482 9/1960 Sullivan ..... 16/114 R
4,955,139 9/1990 Clotten et al. ..... 30/329

FOREIGN PATENT DOCUMENTS 0283445 9/1988 European Pat. Off. ..... 30/340

*Primary Examiner*—Douglas D. Watts
*Assistant Examiner*—Hwei-Siu Payer
*Attorney, Agent, or Firm*—Baker, Maxham, Jester & Meador

[57] ABSTRACT

A knife handle grip is provided which is receivable on the rear end of a utility knife. The utility knife includes a slidable blade mechanism for moving a blade longitudinally within the handle between a first position enclosed in the handle and a second position extending out and into the handle. The grip is receivable on the end of the handle which is opposite the end through which the blade extends. The grip includes an elongate sheath with indentations for receiving the fingers of a user and also includes a pair of flexible spacer flanges foldable into the sheath for retaining a knife handle therein.

11 Claims, 1 Drawing Sheet

HANDLE GRIP FOR A UTILITY KNIFE

BACKGROUND OF THE INVENTION

The invention relates generally to utility knives in which a blade is slidably contained within an elongated handle and moved longitudinally therein. More particularly, the invention relates to a removable handle grip for such knives. More particularly still, the invention concerns such a grip with contours which can be grasped by a user and which will prevent slippage of the knife during use.

U.S. Pat. Nos. 4,586,256 and 4,621,425 describe a utility knife having an elongated handle and a blade slidably mounted within the handle and moveable longitudinally therein between a first position at which the blade is fully contained in the handle, and a second extended position at which the blade extends through an opening in the end of the handle. These patents are incorporated herein by reference.

Utility knives which conform to the descriptions in the incorporated patents are available from Stanley Company, New Briton, Conn., and are identified as Stanley 10-099 utility knives.

The handles on these utility knives are smooth and hard and afford no contouring or surface texturing to assist gripping. As a result, when such a utility knife is being used, it can tire the hand of the user, particularly when used for long periods of time.

Accordingly, there is a need to provide structure on the smooth handle of a utility knife which can be gripped to provide comfort and alleviate tiring of the user's hand during use.

SUMMARY OF THE INVENTION

The invention is based on the inventor's critical observation that a sheath-like handle with appropriate contouring would, when fitted over the smooth rear end of a utility knife handle, provide a means for retaining the knife in the hand of a user when the knife is in use.

Accordingly, the invention is a knife handle grip receivable on the smooth rear end of a utility knife handle and including a plurality of indentations for receiving the fingers of a user to prevent tiring the user's hand.

A significant advantage of the invention is the provision of flexible, bendable spacers at an open end of the grip which can be folded inwardly to afford a tight, non-slipping engagement between the handle of the utility knife and the knife handle grip.

These and other important objectives and advantages are provided by a knife handle grip presented in the following detailed description and illustrated in the below-described drawings.

DETAILED DESCRIPTION OF THE PREFERRED EMBODIMENT

Figure 1:
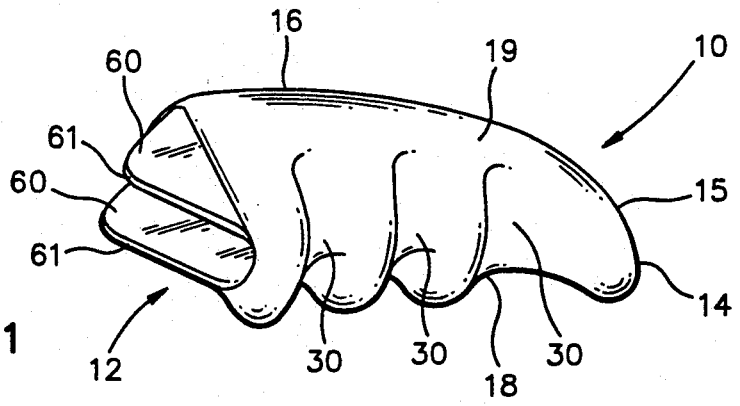
FIG. 1 is perspective view of the knife handle grip.
Figure 2:
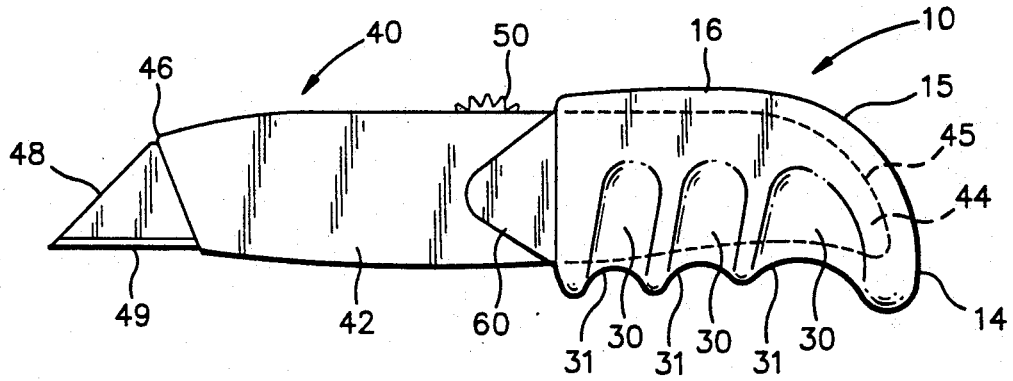
FIG. 2 is a side elevational view of the knife handle grip showing it engaged to the rear of a utility knife handle.
Figure 3:
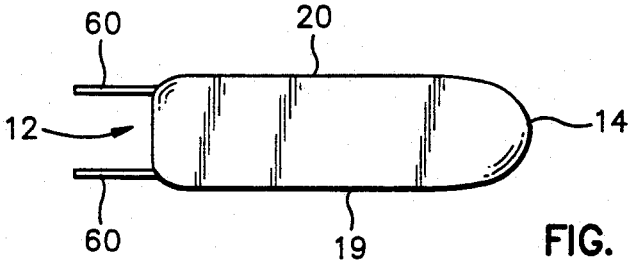
FIG. 3 is rear elevational view of the knife handle grip.
Figure 5:
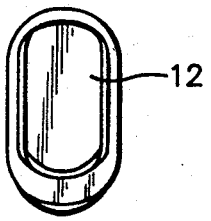
FIG. 5 is a top plan view of the knife handle grip.

FIG. 1 is an illustration of the knife handle grip of the invention, showing it in a side perspective view. In this and the other figures, the knife handle grip ("grip") is indicated by reference numeral 10. As FIGS. 1, 2, and 3 show, the grip 10 is an elongated sheath-like apparatus with an open end 12 and a closed rear end 14. The grip 10 includes a rear edge 16 which is joined to the rear end 14 by a curved lower transition 15. Opposite the rear edge 16 is a front edge 18 which extends between the open end 12 and closed rear end 14. The grip 10 has two sides, a left side 19 and a right side 20. Each of the sides 19 and 20 extends between the rear edge 16 and the front edge 18.

Figure 4:
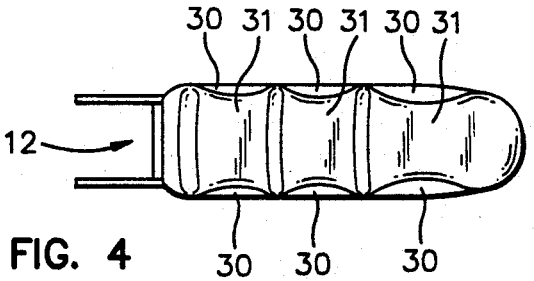
FIG. 4 is front elevational view of the knife handle grip.

As best seen in FIGS. 1, 2, and 4, the grip 10 includes a plurality of indentations, each extending substantially from the left side 19, across the front edge 18, to the right side 20. On each of the sides 19 and 20, a respective indentation 30 forms a depression or channel which can receive the finger of a user. Each of the indentations 30 forms a respective recess 31 in the front edge 18 which enables a user's finger to curl over the front edge 18, to seat in an indentation 30 in one of the sides and thereby to apply a firm grip through the knife handle grip to a utility knife. Preferably, there are three indentations and corresponding recesses in the grip 10.

Figure 6:
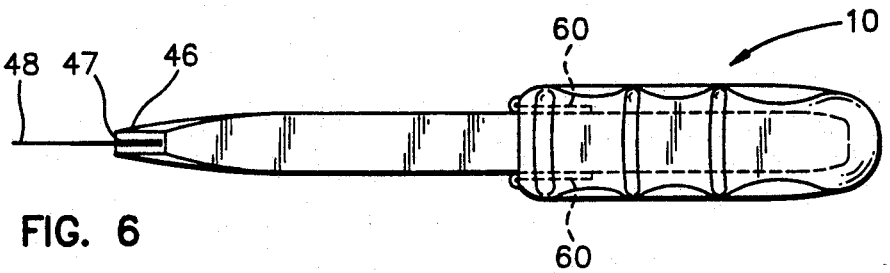
FIG. 6 is a front elevational view of the knife handle grip showing spacers on the grip in frictional engagement with the handle of a utility knife.

FIGS. 2 and 6 show the grip 10 in tight frictional engagement with the rear end of a handle of a utility knife 40. The utility knife 40 includes a contoured handle 42 which has a substantially rectangular cross-section and which tapers at its rear end 44 along a curved portion 45 to which the curved portion 15 of the grip conforms. The knife 40 includes a forward end 46 with a knife blade opening 47 through which the blade 48 of a retractable blade assembly extends. The mechanism for moving the blade within the knife handle 42 is not shown in these drawings; however, it can be fully understood with reference to the incorporated patents. As the incorporated patents teach, the blade 48 is moveable between a first position at which it is fully contained within the knife handle 42 and second position at which it extends out of the knife opening 47 at the front end 46 of the handle 42. A thumb-knob 50 is slidably mounted on the top edge of the handle 42 and is connected to the blade moving mechanism. The knob 50 allows the user to move the blade between its first and second positions by movement of the knob 50.

As FIGS. 2 and 6 illustrate, the grip 10 is shaped to receive the rear end 44 of the knife handle 42 and is dimensioned such that, when seated on the rear end of the handle 42, it permits full movement of the thumb knob 50. Further, when the grip 10 seated in its intended location on the handle 42, the recesses 31 on the front edge 18 of the grip 10 are on the same side of the handle 42 as the cutting edge 49 of the blade 48.

The grip 10 is dimensioned to fit tightly to, and frictionally engage, a standardly-dimensioned utility knife. However, in case the dimensions of the knife handle 42 are such that the handle fits loosely in the grip 10, a pair of spacer flanges 60 are provided on the grip 10 adjacent and spaced on either side of the open end 12. As seen in FIGS. 1 and 2, each spacer has a substantially triangular shape including a base at which the spacer is attached to the grip 10 and a rounded apex 61. The spacers are flexible, bendable members and, when the blade handle fits loosely in the grip 10, may be folded inwardly into the grip 10 through the open end 12 each to a position within the open end which is substantially parallel to and adjacent to a respective side of the grip 10 and at which the knife handle 42 is frictionally engaged.

Preferably, the grip is formed from a moldable, plastic material by an injection molding process that results in the grip being slightly flexible and deformable to accommodate the entry and exit of the rear end of a utility knife handle. Further, the molding of the spacer flanges 60 gives them "memory" of their upstanding position such as is illustrated in FIGS. 1–4. In this regard, after the spacer flanges have been folded inwardly into the interior space of the grip 10 through the open end 12 to retain a knife handle as shown in FIG. 6, they will return to their upstanding positions when the knife handle is removed.

While I have described a preferred embodiment of my knife handle grip, it should be understood that modifications and adaptations thereof will occur to persons skilled in the art. Therefore, the protection afforded my invention should only be limited in accordance with the scope of the following claims.

I claim:

1. A knife handle grip, comprising:

an elongate sheath with an open end and a closed end, a front edge and a back edge, and first and second side, both the first side and second side transitioning to the front and back edges;

a curved transitional surface joining the back edge and the closed end;

a plurality of indentations, each indentation extending substantially around the sheath from the first side to the second side across the front edge and forming a respective recess on the front edge; and a pair of spacer flanges on the elongate sheath in a spaced relationship on either side of the open end, each spacer flange being bendable into the interior of the elongate sheath through the open end to a position which is substantially parallel and adjacent to a respective side of the elongate sheath.

2. The knife handle grip of claim 1, the elongate sheath having an interior shape to receive an elongate handle of a utility knife.

3. The knife handle grip of claim 1, wherein the plurality of indentations comprise three indentations.

4. The knife handle grip of claim 1, each spacer flange including a substantially triangular member having a base attached on a respective side of the open end and having a substantially rounded apex.

5. A cutting tool, comprising:

a utility knife having an elongate handle with a front end and a rear end;

a blade opening on the front end;

a blade assembly in the handle with a blade, the blade assembly being slidable within the handle between a first position at which the blade is contained within the handle and a second position at which the blade extends out of the blade opening;

a means slidably mounted on the outside of the handle and connected to the blade assembly for moving the blade assembly to the first and second positions;

a grip removably mounted on the handle and extending over the rear end of the handle to a location between the rear end and the means for moving the blade, the grip including:

an elongate sheath with an interior shape to receive and grip the elongate handle, the sheath including an open end for receiving the elongate handle, a closed end for retaining the rear end of the elongate handle, a front edge and a back edge, and a first and second side, both the first and second sides joining the front and back edges;

a curved transitional surface joining the back edge and the closed end; and a plurality of indentations, each indentation extending substantially around the elongate sheath from the first to the second surface and forming a respective recess on the front edge.

6. The cutting tool of claim 5, wherein the elongate sheath further includes a pair of flexible spacer flanges mounted on the elongate sheath on either side of the open end substantially at a respective side of the elongate sheath, each spacer flange being bendable through the open end to a position within the elongate sheath substantially parallel and adjacent to the respective side of the elongate sheath.

7. The cutting tool of claim 5, wherein the plurality of indentations comprise three indentations.

8. The cutting tool of claim 5, each spacer flange including a substantially triangular member having a base attached to the elongate sheath on a respective side of the open end and having a substantially rounded apex.

9. The cutting tool of claim 5, further including means mounted on the elongate sheath and acting between the first and second sides and the rear end of the elongate handle for frictionally retaining the rear end of the elongate handle in the elongate sheath.

10. A knife handle grip, including:

an elongate sheath having an aperture shaped to receive a knife handle, the elongate sheath including an open end and a closed end, a front edge and a back edge, and first and second sides, both the first side and second side transitioning to the front and back edges;

a curved transitional surface joining the back edge and the closed end;

a plurality of indentations, each indentation extending substantially around the sheath from the first side to the second side across the front edge and forming a respective recess on the front edge; and flexible and bendable retaining means on the elongate sheath adjacent the open end for acting against the sides of the elongate sheath when said retaining means is folded inwardly into said aperture to produce a frictional retaining force.

11. The knife handle grip of claim 10, wherein the means includes a pair of flanges mounted on the elongate sheath on either side of the open end, each spacer flange being bendable into the interior of the elongate sheath through the open end to a position which is substantially parallel and adjacent to a respective side of the elongate sheath.

* * * * *